US006726351B2

(12) United States Patent
Dillman

(10) Patent No.: US 6,726,351 B2
(45) Date of Patent: Apr. 27, 2004

(54) APPARATUS AND METHOD FOR CONTROLLING THE FLOW OF MATERIAL WITHIN ROTARY EQUIPMENT

(75) Inventor: Bruce A. Dillman, Cape Coral, FL (US)

(73) Assignee: Dillman Equipment, Inc., Prairie du Chien, WI (US)

( * ) Notice: Subject to any disclaimer, the term of this patent is extended or adjusted under 35 U.S.C. 154(b) by 98 days.

(21) Appl. No.: 10/167,142

(22) Filed: Jun. 11, 2002

(65) Prior Publication Data

US 2003/0227815 A1 Dec. 11, 2003

(51) Int. Cl.[7] ..... F27B 7/16

(52) U.S. Cl. ..... 366/57; 366/228; 432/118; 34/599; 110/227

(58) Field of Search ..... 366/57, 56, 54, 366/228, 225, 22, 23, 24, 25; 432/118; 110/227; 34/599, 109

(56) References Cited

U.S. PATENT DOCUMENTS

| | | | | |
|---|---|---|---|---|
| 1,009,225 A | | 11/1911 | Cummer | |
| 2,752,130 A | | 6/1956 | French | |
| 2,815,940 A | | 12/1957 | Madsen | |
| 3,098,797 A | | 7/1963 | Graff et al. | |
| 3,296,711 A | * | 1/1967 | Earl et al. | 366/228 |
| 3,409,998 A | | 11/1968 | Hurst et al. | |
| 3,641,683 A | | 2/1972 | Preeman | |
| 3,717,937 A | | 2/1973 | Thompson | |
| 3,780,447 A | | 12/1973 | Fales | |
| 3,814,588 A | * | 6/1974 | Eweson et al. | 34/109 |
| 4,014,643 A | | 3/1977 | Musha et al. | |
| 4,136,966 A | | 1/1979 | Mendenhall | |
| 4,307,520 A | | 12/1981 | Lutz | |
| 4,338,732 A | | 7/1982 | Coxhill | |
| 4,391,206 A | * | 7/1983 | Matteini | 432/118 |
| 4,628,614 A | | 12/1986 | Thompson | |
| 4,940,334 A | | 7/1990 | Musil | |
| 5,083,382 A | | 1/1992 | Brashears | |
| 5,325,610 A | | 7/1994 | Jou | |
| 5,515,620 A | | 5/1996 | Butler | |
| 5,558,432 A | | 9/1996 | Swisher, Jr. | |
| 5,772,317 A | | 6/1998 | Butler | |
| 6,110,430 A | | 8/2000 | Swisher, Jr. et al. | |
| 6,132,560 A | | 10/2000 | Gerstenkorn | |
| 6,185,842 B1 | | 2/2001 | Brashears | |

* cited by examiner

*Primary Examiner*—Tony G. Soohoo
(74) *Attorney, Agent, or Firm*—Wallenstein Wagner & Rockey, Ltd.

(57) ABSTRACT

The present invention is to a method and apparatus for changing the flighting (20) within a mixing drum (12). A plurality of radially spaced apart doors or paddles (30) are connected to one of the two adjacent supports (60). Each door or paddle (30) is pivotally connected (35,34) to the interior (13) of the drum (12) and can be either open or closed depending on which fixed support (60) the door/paddle is connected to.

23 Claims, 7 Drawing Sheets

APPARATUS AND METHOD FOR CONTROLLING THE FLOW OF MATERIAL WITHIN ROTARY EQUIPMENT

DESCRIPTION

1. Technical Field

The present invention generally relates to regulating the flow of material within rotary equipment, and more particularly, to a method and apparatus for controlling the amount of material picked up and veiled while drying aggregate materials, such as asphalt, within a dryer drum.

2. Background of the Invention

Asphalt is typically produced by heat drying virgin asphalt aggregate and by adding to it and mixing with it liquid asphalt cement, fillers and other additives, often including recycled asphalt pavement. Often times, asphalt is also made by drying virgin asphalt aggregate and moving it to a batch plant tower for batch mixing with the asphalt and other additives.

Asphalt manufacturing machines producing paving compositions are well-known. Generally, such machines include an area or chamber for heating and drying the aggregate and a area or chamber for mixing the heated and dried aggregate together with other materials, such as asphalt cement, liquid asphalt, fines, etc. There are generally two types of mechanisms for making aggregate dryers, that being parallel flow and counterflow. In a parallel flow dryer, cold, wet material is introduced into the cylindrical dryer near the combustion zone. The material to be dried is continuously fed into the upstream end of the dryer where the burner is located. By contrast, the burner of a counterflow dryer is located at the downstream or discharge end of the dryer. The cold, wet material enters the dryer on the upstream end and moisture is gradually driven off and the aggregate temperature is raised as the material progresses downstream in the dryer. A drying drum, dryer or cylinder is where particles are moved generally from the front to the back while being heated by a centrally located burner to dry. Within the drum, fixed flights are attached to the interior cylinder wall to stir the mixture. These flights are the internal "paddles" secured to the dryer's wall used to deflect and direct the mixture/aggregate as the aggregate moves and travels through the dryer. Flights also enhance the mixing of the mixture and prevent the mixture from sticking to the interior wall or around the wall. These flights pick up the mixture at the bottom of the rotating drum and drop the mixture as the drum rotates. The amount and specific locations of the dropped mixture will depend on the material being dried, the speed of the rotation and the profiles of the flights. Often times the pattern of the flowing and cascading mixture within the drum caused by the flights is referred to as the veil or the veil profile because the mixture takes on a certain profile throughout the drum. Generally, the veiling aggregate is more dense on the uphill side of the rotating drum than the downhill side of the drum.

As the aggregate is tumbled and dried in the dryer, dust is naturally created and carried by the hot gases of combustion. Emission regulations prohibit the discharge of such gases with dust to the atmosphere. In addition, depending on the speed of rotation and the temperature of the dryer, the dust created may represent a portion of the fine aggregate material needed in the particular mix. As a result, dust collection or recovery systems, such as baghouses and cyclone separators, are used for the removal of the dust before further processing of the gases and exhaustion to the atmosphere. The dust and gas conveyed to a baghouse or other similar air or gas filtration means are separated; the dust is separated collected for later use while the gases are vented to the atmosphere.

The interior of such a dryer can reach 300° F.–500° F. Typically, in a counterflow system, the air temperature in the drum is around 400° F. with the temperature in this region of the burner reaching up to 3,000 degrees Fahrenheit. To reach the maximum rated capacity of an asphalt plant, the exhaust temperature exiting the stack of the baghouse should be in the range of between 220° F. and 250° F. at about 70° F. ambient temperature. Over time, it has been observed that the stream of gasses will loose about 10° F. to 30° F. from the time it exits the dryer and passes through the duct work and baghouse. By controlling the temperature in the baghouse stack, one can control the efficiency of the dryer. In short, it has been found that one way to control efficiency of the aggregate dryer, or mixer drum, is to control the stack temperature of the baghouse.

Compounding the above observations, it has been noted that if the exhaust stream entering the baghouse exceeds 250° F., energy is being wasted. If the temperature exceeds 350° F., the nomax bags used for filtering the air can be damaged and loose their filtering ability. Replacing the bags is expensive.

Further, aggravating the above, unfortunately, mixer drums or aggregate dryers are not run at the same levels all of the time. They are operated in a wide range of production rates. If, for example, an operator reduces a production level to fifty percent (50%), the exhaust temperature generally will fall below 200° F. This creates a dangerous condition because if the exhaust temperature drops below 180° F., moisture can accumulate in the baghouse. Moisture combined with dust form mud which can blind the bag, effectively shutting down the baghouse.

One way to control the baghouse stack's temperature is to adjust the aggregate being picked up and veiled; in short, controlling the veil. This is accomplished by manipulating the flights to change the drum's profile. Thus, if one can control the flights as one adjusts the production level, one is theoretically capable of controlling the baghouse stack's temperature and the system's efficiency.

Over the years there have been many attempts to design variable flights. One of the most common approaches today is to have one or more people enter the dryer and physically remove some of the flights from the interior of the dryer when the production level is to be decreased. If the production level is to be increased, the flights removed are physically reattached and put back into place. This approach has many down sides. First, it is labor intensive and time consuming. Second, it is very imprecise.

In another approach, the internal flights are set or established at 75% rated capacity of the system. This approximation permits one to theoretically operate within a 50%–100% production level. However, this is not true. As the system approaches 100% capacity, the exhaust temperature will rise substantially and the efficiency of the dryer will be reduce accordingly. In the same vein, attempts have been made to remove some of the flights within the dryer to accommodate lower production levels. However, again, as production rates increase, the exhaust temperature rises substantially, diminishing system efficiency. At times, the exhaust temperatures to the baghouse become so great, that the baghouse controls shut off the burner fuel valve and hence the burner in the dryer. This is because baghouses are equipped with sensors to monitor the temperature of the exhaust gas stream and to shut off fuel to the burner when the temperature exceeds about 350° F. A way around this is to physically add flights as production increases, a laborious task.

Other teachings learned over time include the fact that combustion flights should not carry aggregate a substantial distance up the interior side wall of a drum as the drum rotates and then allow the aggregate to fall vertically down the interior face of the combustion flighting. This is because the deflection of dust and aggregate particles can enter the combustion zone, impinging on the combustion process. The flights must also be able to withstand intense heat (2,400° F. to 3,200° F.) for extended periods of time without warping, distorting, or simply burning up; thus preventing the aggregate from falling between the flights and contaminating the combustion zone.

Others have tried methods and means for modifying flights. Such attempts are shown in U.S. Pat. Nos. 5,083,382 to Brashears; 5,515,620 to Butler; 3,641,683 to Preeman; 6,132,560 to Gerstenkorn; 6,110,430 to Swisher et al.; 5,558,432 to Swisher; 4,940,224 to Musil; 4,307,520 to Lutz; 4,136,966 to Mendenhall; 3,780,447 to Fales; 3,717,937 to Thompson; 3,098,797 to Graff et al.; and 1,009,225 to Cummer. The patent to Brashears discloses a rotary drum dryer including a plurality of circumferentially spaced flights. A radially inwardly directed dam is interposed between each flight section and serves as a pivotal mount for the flights. The angular position of the flights is changeable before operating the drum by locating bolts on the flights in selected detented positions in arcuate tracks. The patent to Butler discloses a method and apparatus for operating a rotatable drying drum. The drum includes identical drying flights, each having a generally U-shaped body with two differently shaped edges. By reorienting the flights within the drying zone by securing them in one of a plurality of orientations before operating the drum, the veiling patterns of the aggregate across the drum may be altered. And, the patent to Preeman discloses an asphalt plant dryer having placed circumferentially to the inner wall pivotally mounted lifter plates adjacent its inlet end. The invention includes adjustable straight lifter plates to minimize the obstruction to the flow of the hot gaseous fluid.

Each of these patents relates to variable flights, requiring an operator to make the correct adjustments to a wide variety of operating conditions. Similarly, the concept of removing flights or totally reorienting them appears quite time consuming and impractical.

As a result, there is a need for a practical method and mechanism for regulating and controlling the pick-up and veiling of materials within a dryer that is neither all consuming nor guesstimating.

SUMMARY OF THE INVENTION

The present invention relates to an apparatus and method for regulating the quantity of aggregates picked up and veiled by the flights in an aggregate dryer. It allows a plant operator to make modifications and orientations to the doors acting as flights in a minimum amount of time. By doing this, the temperature in the air stream exiting the baghouse stack is controlled and the efficiency of the system is maintained and preserved. This, in turn, saves on the fuel consumed by the system.

The development is a flight incorporating hinged doors or plates that are easily opened or closed (approximately 20 minutes). The internal configuration of the dryer can be easily changed. Each flight has a support, door, hinge and fasteners. The door is attached to the hinge and is attached to its home support or adjacent support. In particular, the door is normally attached to its "home" support—"the open position." Optionally, the door can be attached to the "adjacent" support—"the closed position." The positions can be changed by merely removing/loosening the connection between the door and one support adjacent the door on one side and rotating the door to the other support adjacent the door on the other side.

This opening and closing of select doors changes the drums' profile and controls the quantity of aggregates carried up the sidewall of the drum and veiled over the cross section of the dryer shell resulting in a change in the flow patterns of the materials in the drum.

In particular, a system for controlling the veil of mixable substance is disclosed for a rotating mixing chamber with an interior surface. A plurality of radially spaced apart plates, each having a first end pivotally connected to the interior surface and a second, distal end. Each plate is optionally rotatable about the first end between an open position and a closed position. A support is disposed between each plate for selectively mating with a single plate on either one side of the support or the other side of the support. The support is connected at a first end to the interior surface and does not move. Thus, the plate is connected to one adjacent support when the plate is in the open position and the plate is connected to the other adjacent support when the plate is in the closed position. Means, such as bolts, are used to connecting the plate to either the one adjacent support or the other adjacent support.

Each plate has at least two sections, a first section adjacent the first end and the pivotal connection and a second section at a distal end thereof. Each section is substantially planar and the two sections are angularly related to one another via an obtuse angle (about 167°). When a plate is in the open position, it is connected to the closest adjacent support with the connection being made with the first section of the plate. When the plate is in the closed position, it is connected to furthest adjacent support (on the other side of the plate from the closest adjacent support) with the connection being made with the second section of the plate. The plate has a plurality of spaced apart apertures therein and the supports have a plurality of openings therein and when the plate is connected to a support, an aperture in the plate is aligned with an opening in the support, a fastener cooperating with both the aperture and the opening.

A method is further disclosed for modifying the pick-up and veiling of a mixture in a rotating drum having an interior surface. This process includes attaching a plurality of flight assemblies to the interior of the drum with each flight assembly including a plate rotatably attached to the interior surface of the drum and the plate having a first end pivotally connected to the interior surface and a movable second, distal end. The plate is rotatable about the first end between an open position and a closed position. A first support, spaced apart from one side of the plate and fixedly connected at a first end to the interior surface of the drum, is made to contact and connect with the plate when the plate is in the open position. A second support, spaced apart from the opposite side of the plate and fixedly connected at a first end to the interior surface, is made to contact and connect with the plate when the plate is in the closed position. An operator needs only to selectively fix each flight assembly to an open position or a closed position by connecting each plate to either the first support on the one side of the plate or the second support on the other side of the plate. Selectively fixing each flight assembly to an open position or a closed position is accomplished by connecting a plate in the open position by connecting the plate to the first support with the connection being made with the first section of the plate or by connecting a plate in the closed position by connecting the plate to the second support with the connection being made with the second section of the plate.

These and other aspects of the present invention set forth in the appended claims may be realized in accordance with the following disclosure with particular reference to the accompanying drawings.

BRIEF DESCRIPTION OF THE DRAWINGS

In the accompanying drawings forming part of the specification, and in which like numerals are employed to designate like parts throughout the same.

DETAILED DESCRIPTION

Figure 1:
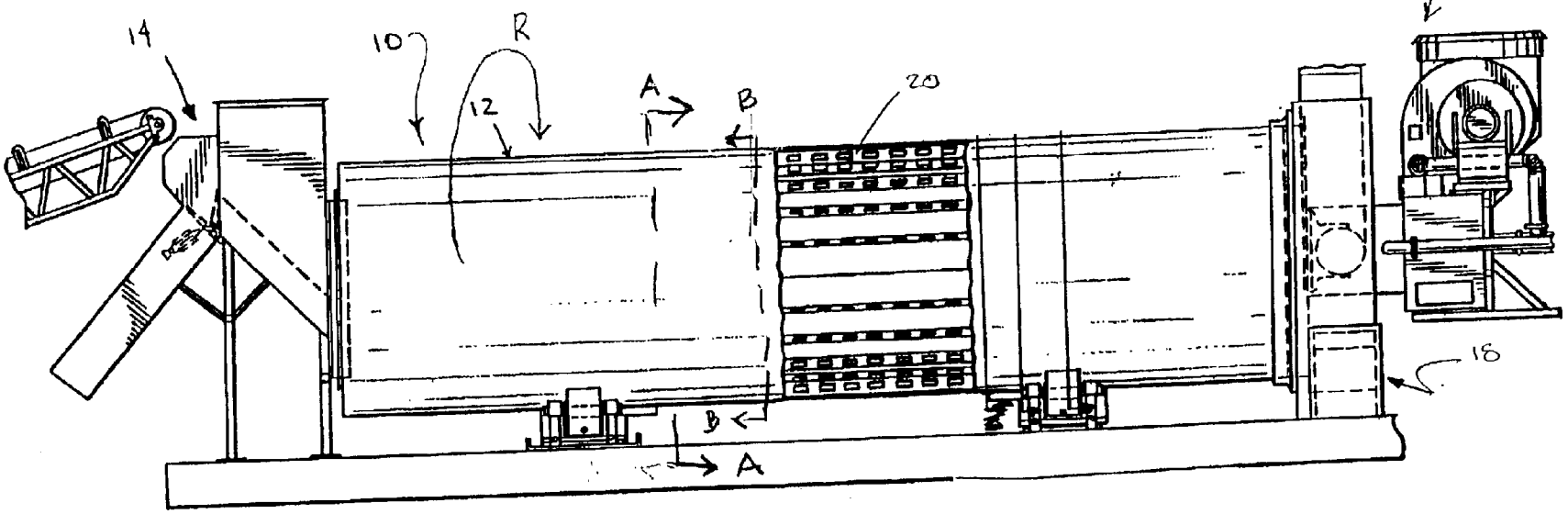
FIG. 1 is a side view of a typical counterflow dryer used in producing asphalt.

While this invention is susceptible of embodiments in many different forms, there is shown in the drawings and will herein be described in detail preferred embodiments of the invention with the understanding the present disclosure is to be considered as an exemplification of the principles of the invention and is not intended to limit the broad aspect of the invention to the embodiments illustrated.

Referring to FIG. 1, a counterflow dryer 10 is shown for drying aggregate. Material to be dried, or aggregate, (not shown) is put into the cylinder drum 12 at the inlet end 14. The cylindrical rotates counterclockwise (R) and the aggregate within the drum 12 (not shown) travels through the drum towards the burner 16 and the discharge door 18. The outer shell of the dryer drum 12 is removed and the internal flights 20 are generally shown.

The aggregate within the dryer is moved by the flights 20 and by gravity (the drum is usually higher at the inlet end 14 than the discharge end 18 so gravity drives the aggregate downstream). The flights 20 act like paddles, deflecting and veiling the aggregate as the drum rotates.

Figure 2:
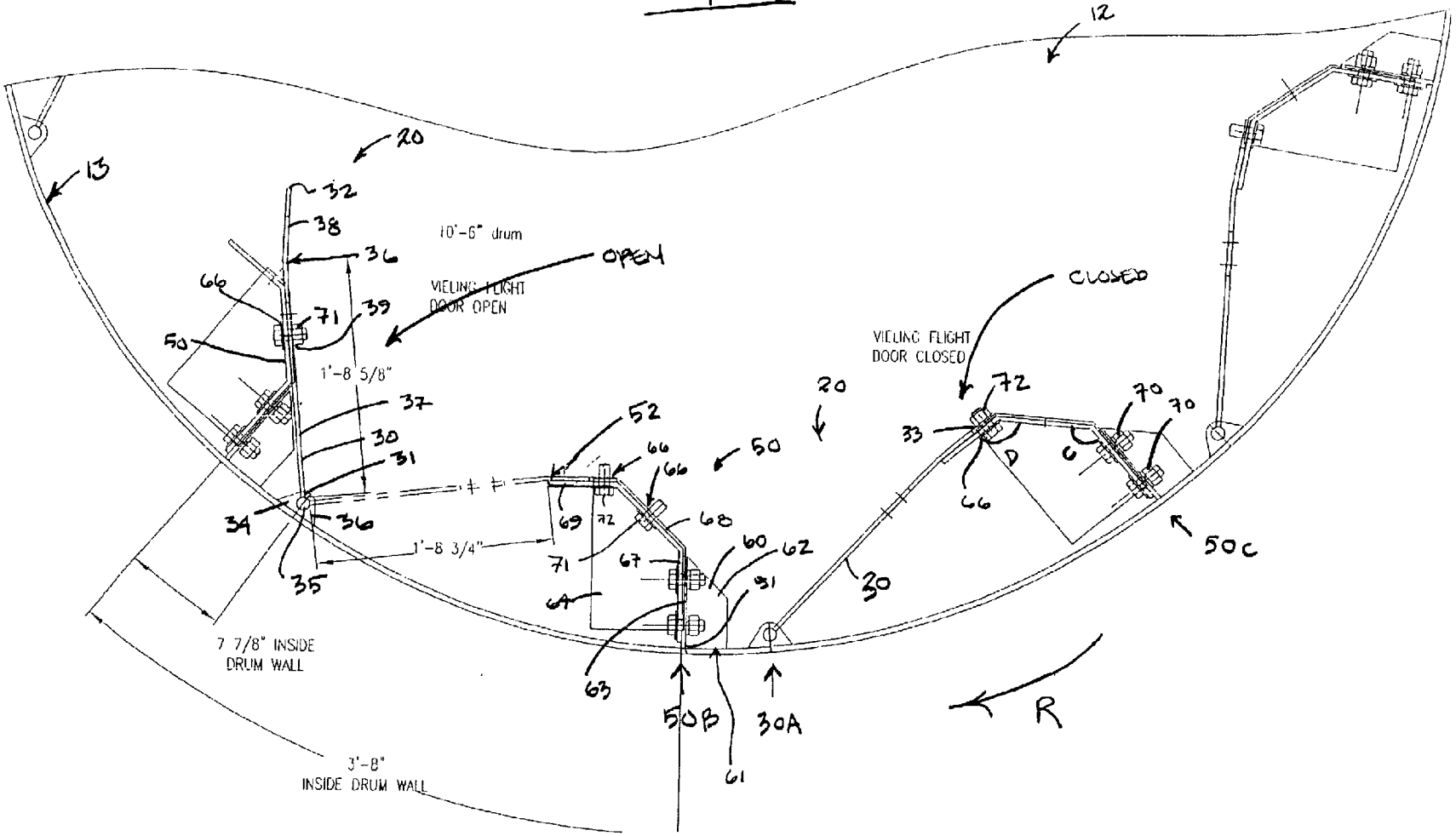
FIG. 2 is partial cross-sectional view of along line B—B in FIG. 1 wherein one flight is open and two flights are closed.

FIG. 2 is a cross-sectional view of a few flights 20 and the interior wall or surface 13 of the drum 12. The drum is about 10'-6" in diameter. Each flight 20 is, in essence, a multi-part assembly. A plurality of these assemblies 20 are radially spaced apart on the interior surface 13 of the drum. In the embodiment illustrated, the flights are spaced (from pivot 35 to the adjacent pivot 35) about 3'-8" apart.

Figure 4:
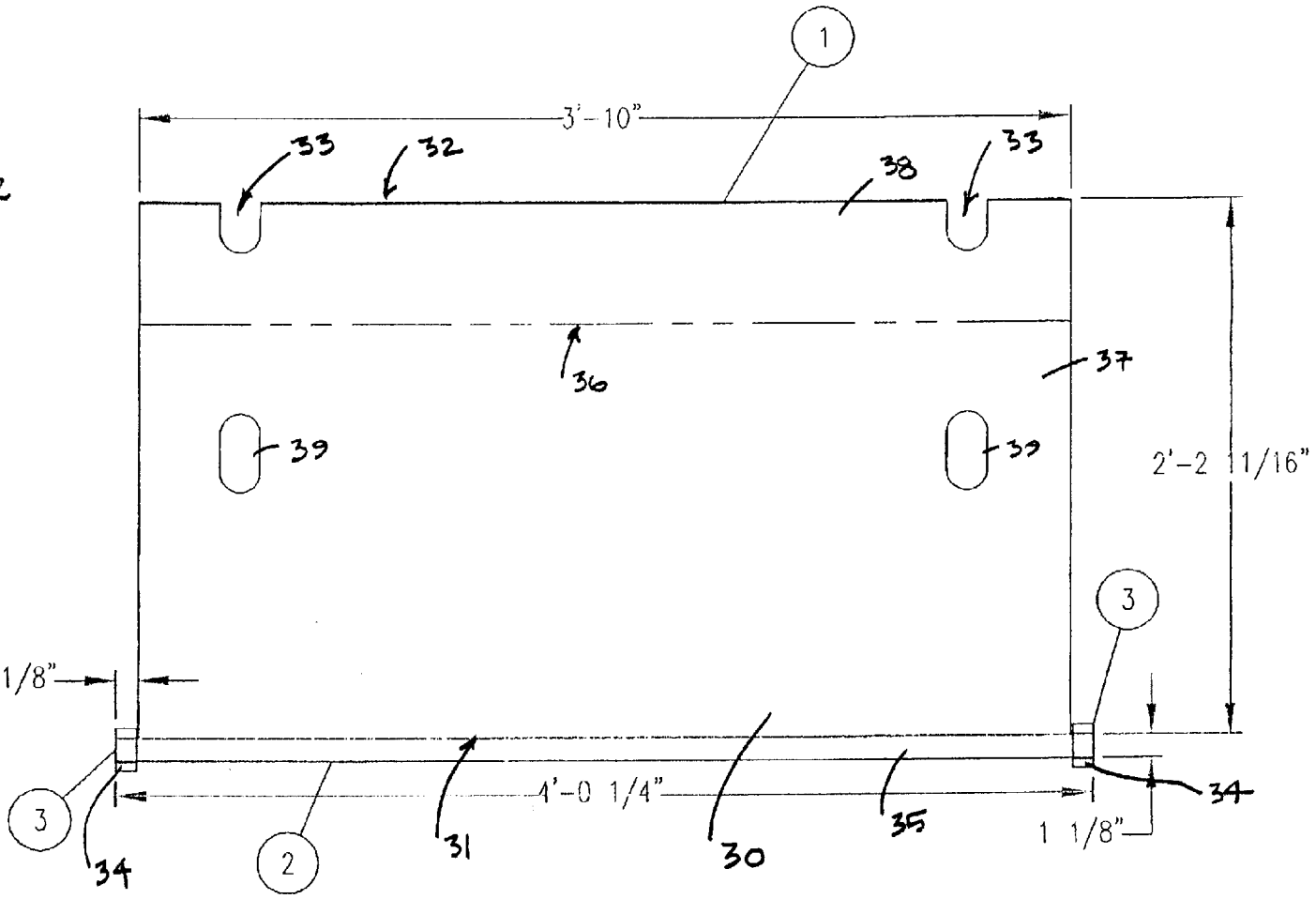
FIG. 4 is front view of a flight.

At the center of each flight assembly, is a plate 30, a substantially flat plate, having a bend therein (FIG. 4). The plate 30 has a first end 31 and a second end 32. Each of these plates 30 are equally spaced apart from one another (about 3'8"). The first end 31 of the plate 30 is pivotally connected to the interior surface 13 of the drum 12. This is accomplished by having the plate 20 constructed like a door or a hinge. As shown in FIG. 2, the hinge is composed of opposed bases 34, a pivot pin 35 and the plate 30 itself. Each base 34 is connected by bolts, welding, rivets or other well known convention fasteners to the interior surface 13. A standard flange can be attached to the base to bolt the base to the interior surface. A pivot pin 35 is in communications with the first end 31 of the plate and free to rotate about the two bases. The plate may be attached to the pin or may just surround the pin, permitting the plate to rotate relative to the bases. Use of this pin 35 permits the plate 30 to rotate about or with the pin relative to the bases between an "open" position and a "closed" position, discussed below.

Figure 3:
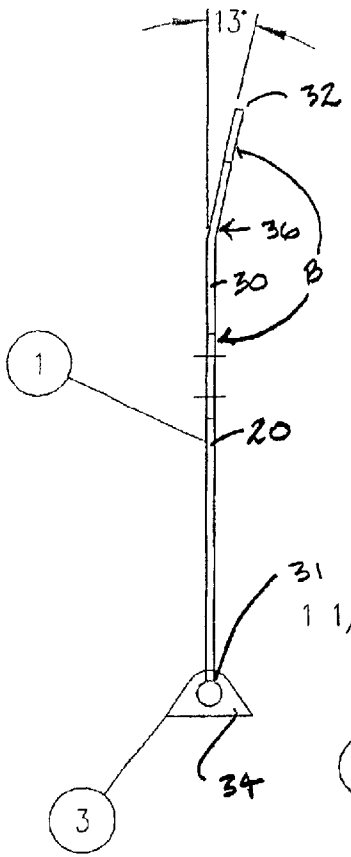
FIG. 3 is side view of a flight.

As shown in the figures, the plate 30 has two sections 37,38 angularly related to one another. A bend or flange 36 is formed parallel to the ends 31,32 defining a the first section 37 and second section 38. The overall bent height of the plate 30 is about 2'-2$^{11}/_{16}$" and the width is about 3'-10". The first section 37 is adjacent the first end 31 and the second section 38 is adjacent the second, distal end 32. Each section 37,38 is planar and the angle (Angle B) the two sections make to one another is obtuse, that being greater than 90 degrees. In practice, the Angle B between the first section 37 and the second section 38 of the plate 30 is about 167° (FIG. 3). The second section 38 is about 13° (180°–167°) from the imaginary plane formed by the horizontal plane of the first section 37.

The plate 30 also includes openings 39 and slots 33 for securing the plate to its proper and desired position, discussed below. The openings 39 are preferably elongated passageways and the slots 33, formed at the second end 32, are preferably elongated as well. This elongation of the openings facilitates bolting in that some play is allowed in when bolting the plate to the support 50.

A support 50 is radially disposed between each rotating plate 30. Though the supports 50 are equally spaced apart from one another, the supports 30 are not evenly spaced between each plate 30. Each of these supports 50 are equally spaced apart from one another (about 3'-8"). The distance between the plate 20 and closest, adjacent support on one side of the plate is about 7⅞" and the distance between the plate and the other adjacent support on the other side of the plate is about 3'⅛".

In FIG. 2, one support (here, the support 50B, to the left of the plate 30A) is closer to the plate than the other support (the support 50C, to the right of the plate 30A). Looking the other way, in FIG. 5, the support 50B, to the right of the plate 30A, is closer to the plate 30A than the other the support 50C, to the left of the plate 30A. In each instance, one adjacent support is closer to the pivoting plate than the other adjacent support.

When the pivoting plate is connected to the one, closer adjacent support, the plate or flight is "open" or in the open position; when the pivoting plate is connected to the other, further adjacent support, the plate or flight is "closed" or in the closed position.

Figure 5:
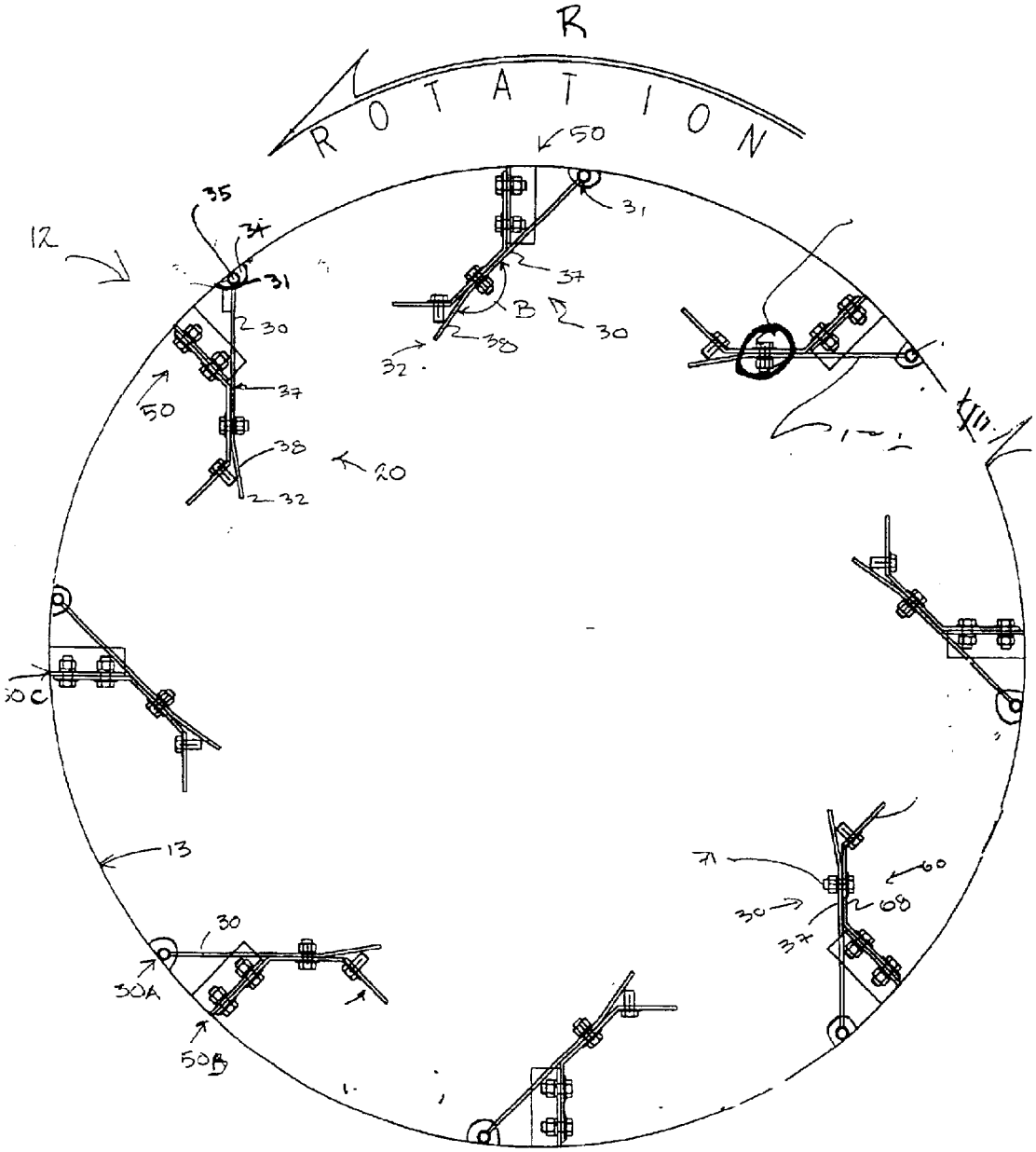
FIG. 5 is diagrammatic cross-sectional view of along line A—A in FIG. 1 wherein all of the flights are in the open position.

Thus, the flight assemblies 20 in FIG. 2 are in both the open and closed positions. In FIG. 5, the flight assemblies 20 are all in the open position; the flight assemblies 20 in FIG. 7 are all closed. Some flight assemblies 20 are open (those identified as A, C, E and G) and some flight assemblies are closed (those identified as B, D, F and H) in FIG. 6.

Figure 6:
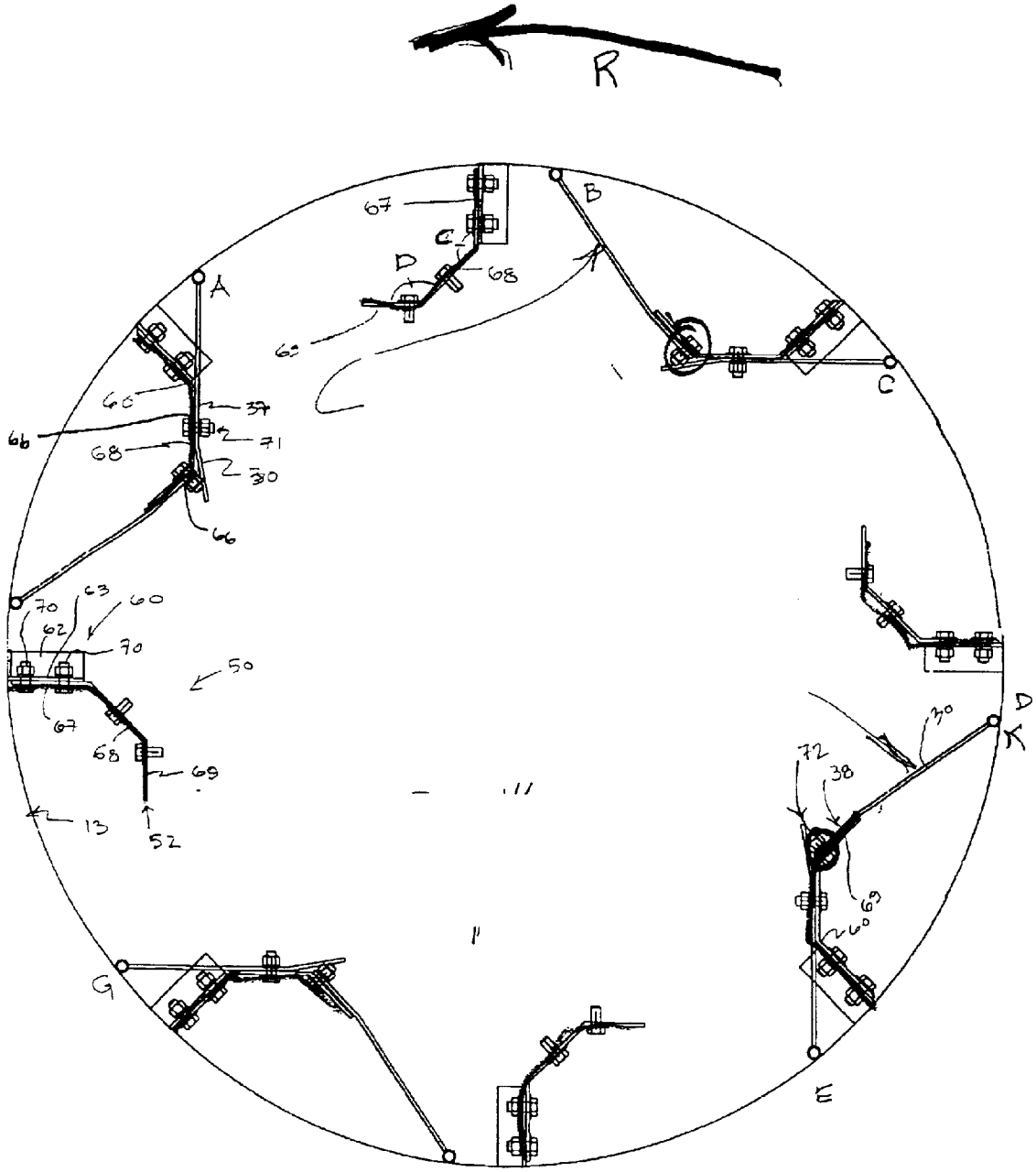
FIG. 6 is view similar to that in FIG. 5 wherein some of the flights are in the closed position and some of the flights are in the open position.
Figure 7:
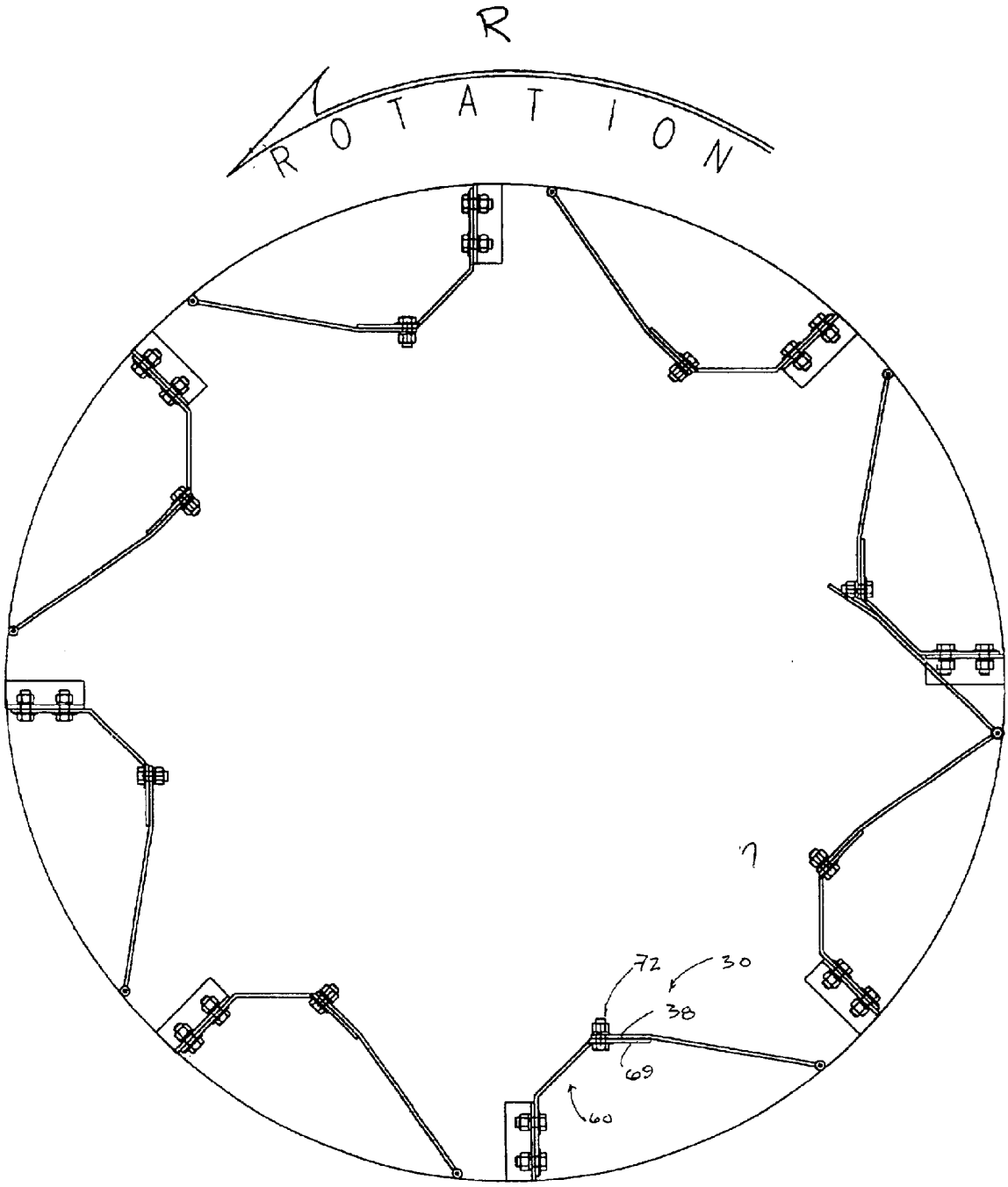
FIG. 7 is a view similar to that in FIGS. 5 and 6 wherein all of the flights are in the closed position; and, FIG. 8 is a side view of a support.
Figure 8:
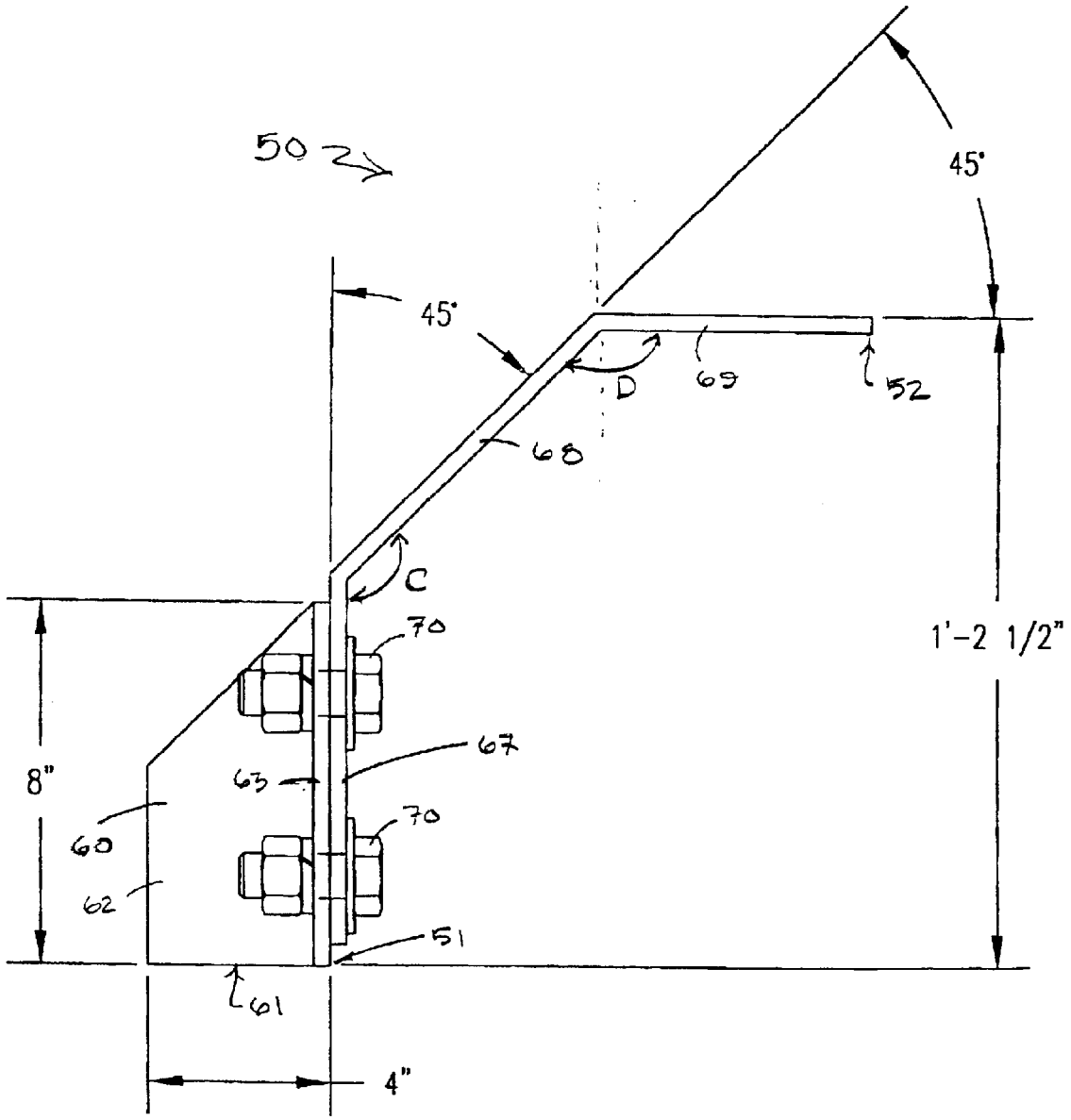
Figure 1:
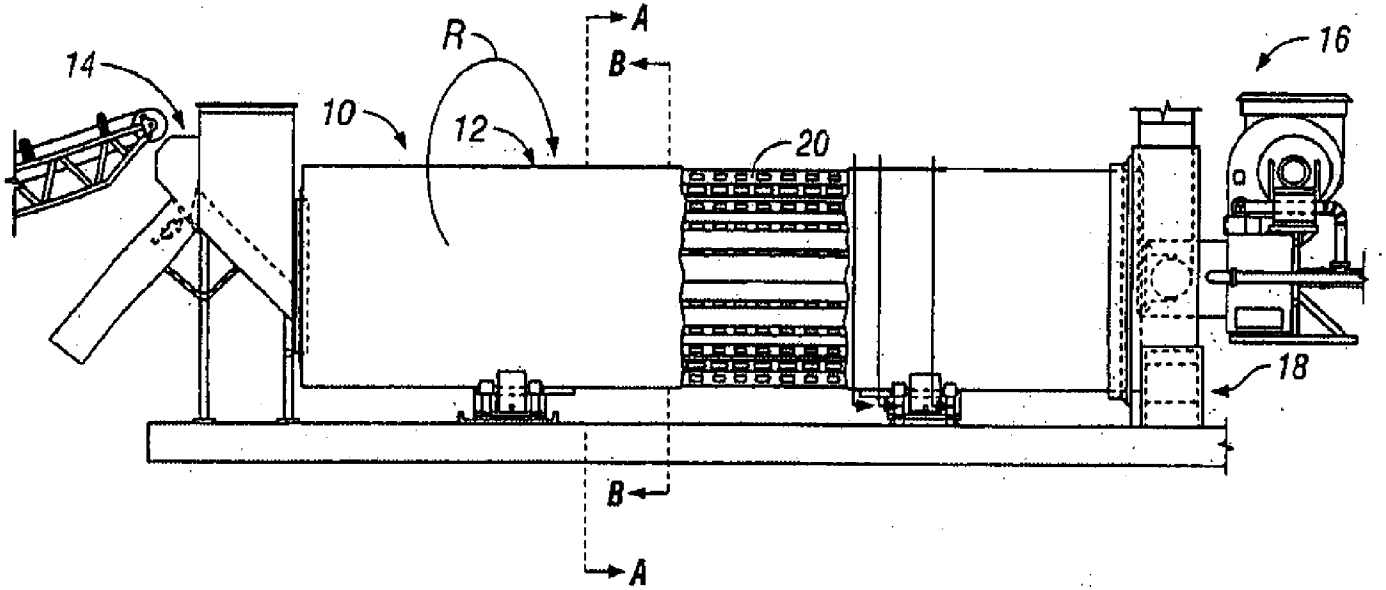
Figure 2:
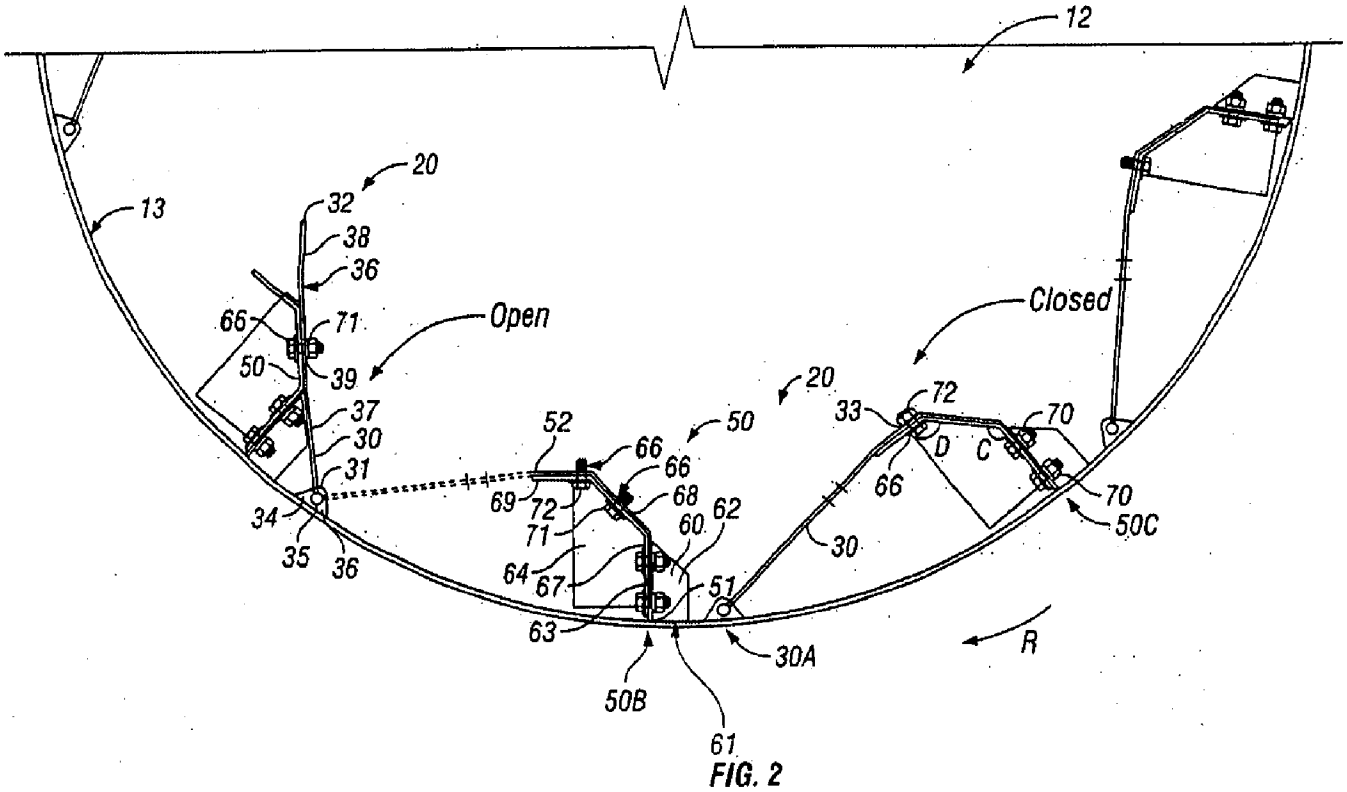
Figure 4:
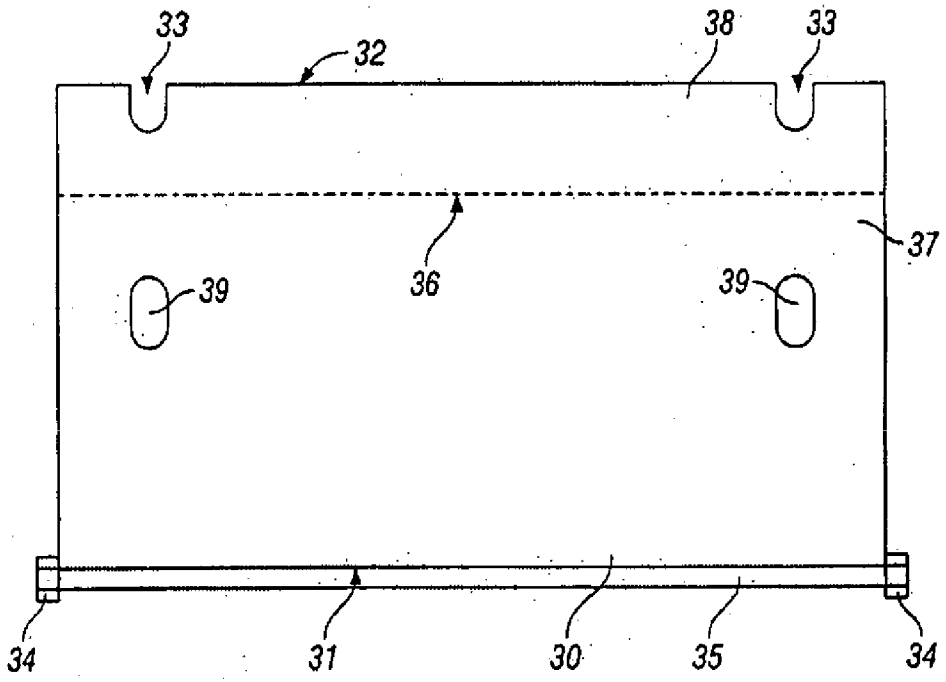
Figure 3:
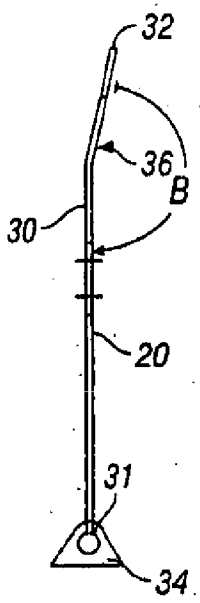
Figure 5:
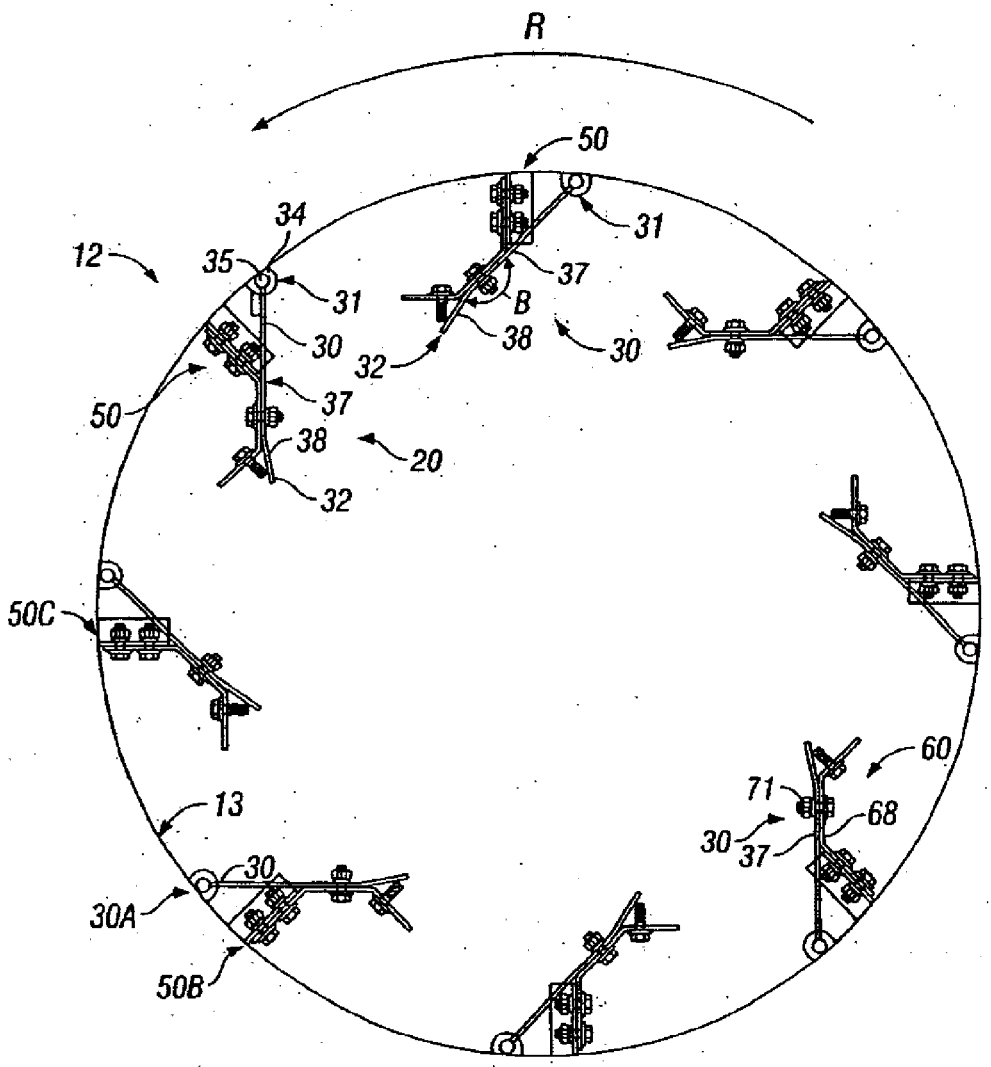
Figure 6:
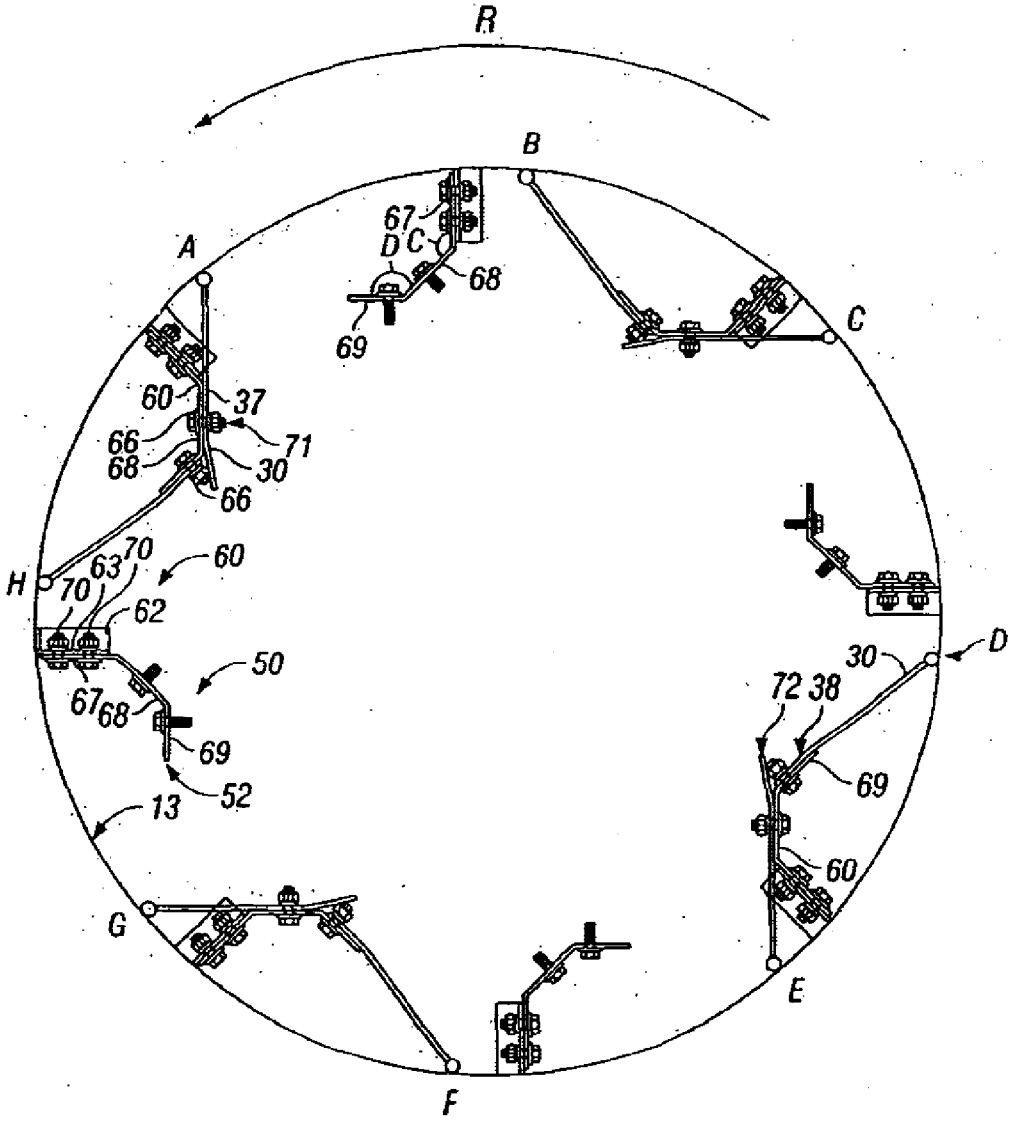
Figure 7:
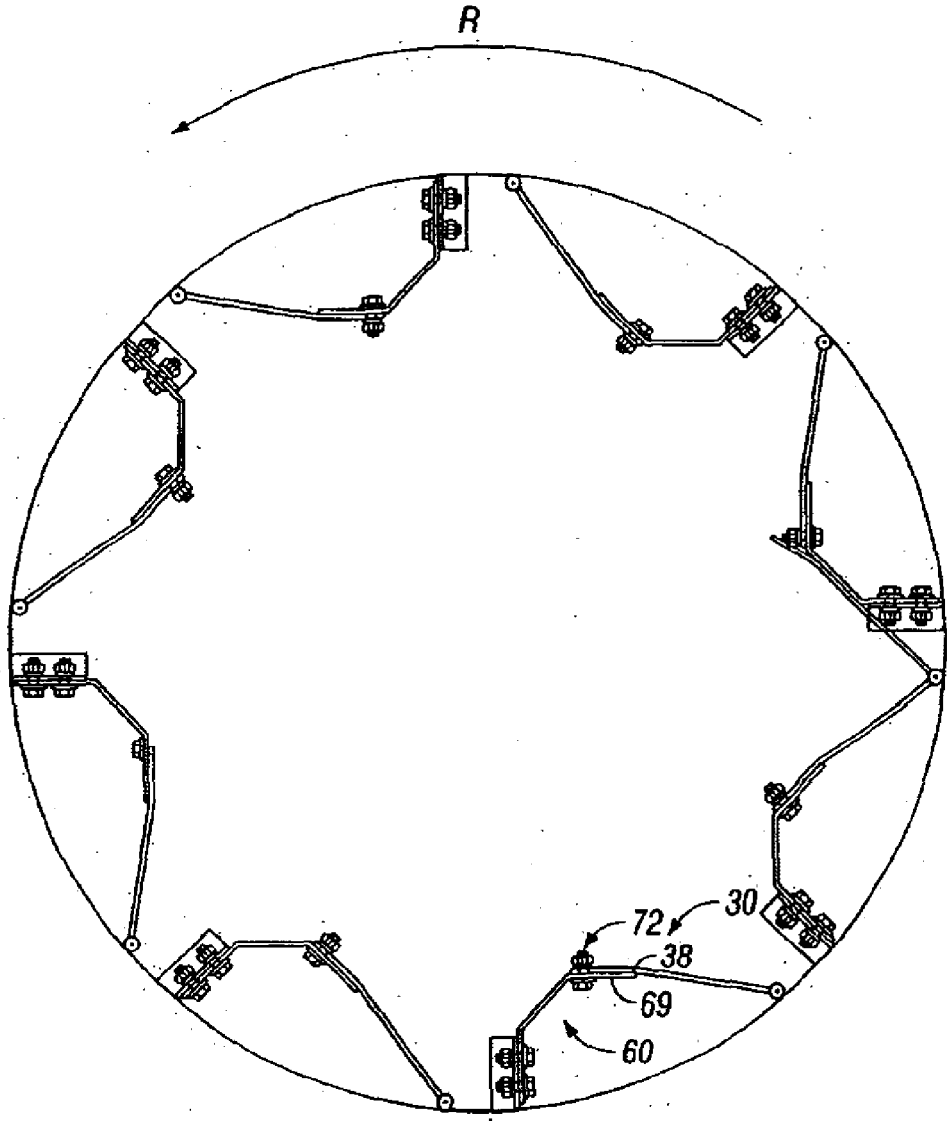
Figure 8:
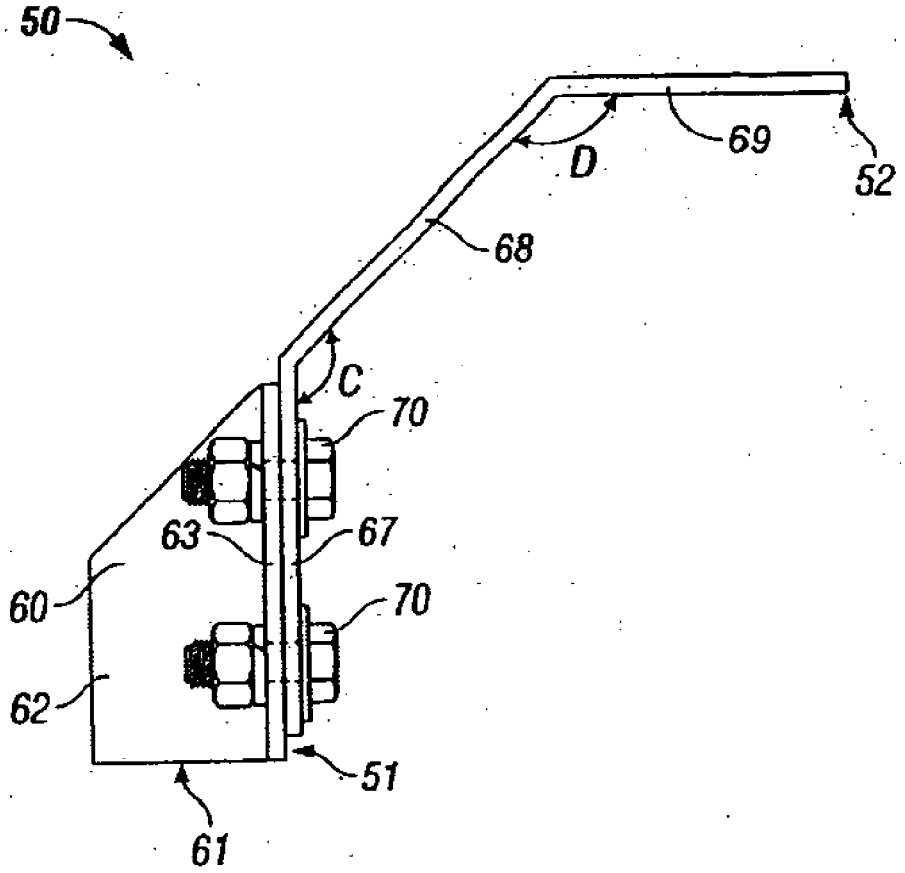

As shown in FIGS. 2, 6 and 8, each support 50 includes a first end 51 and a second, distal end 52. The first end 51 of the plate 50 is fixedly connected to a channel member 60. The channel member, 60 has a first flange 61—connected by bolts, welding, rivets or other well known convention fasteners to the interior surface 13 of the drum—a second flange 62—for added support and rigidity—and a third flange 63—connected by bolts 70 to the support 50. A fourth flange 64 (FIG. 2) may also be similarly attached and added for additional support and rigidity.

The support 60 has preferably three primary sections 67,68,69 angularly related to one another. The first section 67 is adjacent the first end 51 and the third section 69 is adjacent the second, distal end 52. The second section 68 is thus disposed between the first section 67 and the third section 69. Each section 67,68,69 is planar and both angles (Angle C between the first section 67 and the second section 68 and Angle D between the second section 68 and the third section 69) are both obtuse, that being greater than 90 degrees. In practice, the Angle C is preferably 135° degrees and the Angle D is preferably 135° degrees.

The support 50 has a vertical height of about 1'-2½".

Shown in FIG. 2, parallel bolt holes 66 (preferably bolt slots) are provided in the second section 68 and the third section 69 of the support 50 for receiving bolts 71 and 72. Specifically, one set of parallel bolts 71 cooperates with the bolt holes 66 in the second section 68 of the support 50 and the other set of parallel bolts 72 cooperates with the bolt holes in the third section 69 of the support 50.

Turning again to FIG. 6, when a flight assembly 20 is in the open position (assemblies A, C, E and G), the first section 37 of the plate 30 contacts and is connected to the second section 68 of the support 60. Here the connection is made by a parallel set of heavy duty bolt assemblies 71. The bolts 71 pass through the bolt holes 66 in the support 60 and the bolt holes 39 in the plate 30. When a flight assembly 20 is in the closed position (assemblies B, D, F and H), the second section 38 of the plate 30 contacts and is connected to the third section 69 of the support 60. Here the connection is made by a parallel set of heavy duty bolt assemblies 72. The bolts 72 pass through the bolt holes 66 in the support 60 and the slots 33 in the plate 30.

Thus, the first section 67 of the support 60 connects the support to the interior wall 13; the second section 68 of the support connects to one adjacent plate 30 when that plate is in the open position; and, the third section 69 of the support connects to the other adjacent plate 30 when that plate is in the closed position. In FIG. 5, with all of the flight assemblies 20 open, all of the supports 60 are mated with an adjacent plate 30 to the left of, or radially clockwise from that one support. In FIG. 7, with all of the flight assemblies 20 closed, all of the supports 60 are mated with an adjacent plate 30 to the right of, or radially counterclockwise from that one support. Finally, in FIG. 6, with some of the flight assemblies 20 open and some closed, some of the supports 60 are connected to both of the plates adjacent to it and some of the plates are not connected to any plates.

To go from the flighting of FIG. 5 to the flighting of FIG. 7, an operator merely needs to unbolt one set of bolts (bolts 71) connecting the one plate 30 to each support 60, pivot the plates, and bolt the other set of bolts (bolts 72) connecting the other plate 30 to each support.

The direction of rotation (Arrow R) of the drum 12 is shown as counterclockwise in FIGS. 5–7 and clockwise in FIG. 2. While the flights have been described as open or closed, it should be noted that any structure or obstacle built upon or off the interior surface 13 of the drum will affect the veil of the aggregate being mixed and moved within the drum. Thus, each flight assembly, plate 30 and support 60, whether open or closed, will still deflect the aggregate. By opening and closing the flight assemblies, the flight profile or flighting within the drum 12 is changed. This also alters the veiling, veil profile or flow pattern of the cascading aggregate. In a drum rotating counterclockwise, and the flight assemblies in the open position, the supports act like troughs, picking up the aggregate at about a 6 o'clock position and drop the aggregate at about between the 2 o'clock position to about the 10 o'clock position. When the flight assemblies are in the closed position, neither the plates nor the supports really hold the aggregate. Rather, they deflect the aggregate. A little holding may occur between the 6 o'clock position and the 4 o'clock position in the spaces between the plates and the supports.

In light of the above, an operator can modify the flighting to the particular need of the situation, e.g., the production level. For example, at capacity levels of between 100% and 75%, the flighting of FIG. 2 is appropriate. At capacity levels of between 50% and 25%, the flighting of FIG. 4 is appropriate. At capacity levels of between 75% and 50%, the flighting of FIG. 3 is appropriate. A calibration or lookup chart can be employed for the operator's use.

Each flight and each supports is preferably made of a single piece of material, more preferably, steel.

While the FIGS. 2 and 5-7 show a single set of circumferentially aligned flights according to the present invention, it is recognized that there can be more than one set of such flights and other components within the drum for controlling the flow and movement of materials. Specifically, there can be individual sets of circumferentially aligned flights annually spaced apart within the drum. For example, a single drum might have 3 sets of flights like those shown in FIG. 2. Instead of hinges A-H, there may be hinges $A_1$-$H_1$, $A_2$-$H_2$ and $A_3$-$H_3$, each annularly spaced from one another. Other flights or directional deflectors can also be placed within the drum to ensure all of the material flows in one direction from one end of the drum to the other end of the drum.

While the specific embodiments have been illustrated and described, numerous modifications come to mind without significantly departing from the spirit of the invention and the scope of protection is only limited by the scope of the accompanying Claim.

I claim:

1. A flight assembly for use with drum having an interior surface, comprising:

a plate having a first end and a second distal end, the first end pivotally connected to the interior surface, the plate being rotatable about the first end between an open position and a closed position;

a first support spaced apart from the plate, connected at a first end to the interior surface and contacting the plate when the plate is in the open position;

a second support spaced apart from the plate, connected at a first end to the interior surface and contacting the plate when the plate is in the closed position; and, means for connecting the plate to either the first support or the second support.

2. The flight assembly of claim 1 wherein the supports are identical.

3. The flight assembly of claim 1 wherein the plate has at least two sections, a first section adjacent the first end and the pivotal connection and a second section at a distal end thereof, and each section is substantially planar and the at least two sections are angularly related to one another.

4. The flight assembly of claim 3 wherein the angle between the first and second sections of the plate is obtuse.

5. The flight assembly of claim 4 wherein the angle between the first and second sections of the plate is between about 159° and about 175°.

6. The flight assembly of claim 5 wherein the angle between the first and second sections of the plate is about 167°.

7. The flight assembly of claim 1 wherein when the plate is in the open position, it is connected to the first support with the connection being made with the first section of the plate and when the plate is in the closed position, the plate is connected to the second support with the connection being made with the second section of the plate.

8. The flight assembly of claim 7 wherein the plate has a plurality of spaced apart apertures therein and the supports have a plurality of openings therein and when the plate is connected to a support, an aperture in the plate is aligned with an opening in the support, a fastener cooperating with both the aperture and the opening.

9. The flight assembly of claim 8 wherein the fastener is a securement bolt.

10. A system for controlling the veil of mixable substance comprising:

a rotating mixing chamber having an interior surface;

a plurality of radially spaced apart plates each having a first end pivotally connected to the interior surface and movable second, distal end, the plate being rotatable about the first end between an open position and a closed position;

a support disposed adjacent to and between each plate and connected at a first end to the interior surface, the plate contacting one adjacent support when the plate is in the open position and the plate contacting the other adjacent support when the plate is in the closed position; and, means for connecting the plate to either the one adjacent support or the other adjacent support.

11. The system of claim 10 wherein each plate has at least two sections, a first section adjacent the first end and the pivotal connection and a second section at a distal end thereof, and each section is substantially planar and the at least two sections are angularly related to one another.

12. The system of claim 11 wherein the angle between the first and second sections of the plate is obtuse.

13. The system of claim 12 wherein the angle between the first and second sections of the plate is between about 159° and about 175° degrees.

14. The system of claim 13 wherein the angle between the first and second sections of the plate is about 167°.

15. The system of claim 10 wherein a plate in the open position is connected to the one adjacent support with the connection being made with the first section of the plate and a plate in the closed position is connected to other adjacent support with the connection being made with the second section of the plate.

16. The system of claim 15 wherein the plate has a plurality of spaced apart apertures therein and the supports have a plurality of openings therein and when the plate is connected to a support, an aperture in the plate is aligned with an opening in the support, a fastener cooperating with both the aperture and the opening.

17. The system of claim 16 wherein the fastener is a securement bolt.

18. A method for modifying the pick-up and veiling of a mixture in a rotating drum having an interior surface, comprising the steps of:

(a) attaching a plurality of flight assemblies to the interior of the drum, each flight assembly including a plate rotatably attached to the interior surface of the drum, the plate the having a first end pivotally connected to the interior surface and a second, distal end, the plate being rotatable about the first end between an open position and a closed position;

a first support spaced apart from one side of the plate, fixedly connected at a first end to the interior surface of the drum, contacting the plate when the plate is in the open position;

a second support spaced apart from another side of the plate, fixedly connected at a first end to the interior surface and contacting the plate when the plate is in the closed position; and, (b) selectively fixing each flight assembly to an open position or a closed position by connecting each plate to either the first support on the one side of the plate or the second support on the another side of the plate.

19. The method of claim 18 wherein each plate has at least two sections, a first section adjacent the first end and the pivotal connection and a second section at a distal end thereof, and each section is substantially planar and the two sections are angularly related to one another.

20. The method of claim 19 wherein the angle between the first and second sections of the plate is obtuse.

21. The method of claim 18 wherein the step of selectively fixing each flight assembly to an open position or a closed position is accomplished by connecting a plate in the open position by connecting the plate to the first support with the connection being made with the first section of the plate or by connecting a plate in the closed position by connecting the plate to the second support with the connection being made with the second section of the plate.

22. The method of claim 21 wherein each plate has a plurality of spaced apart apertures therein and each supports has a plurality of openings therein and the step of selectively fixing each flight assembly to an open position or a closed position is accomplished by aligning an aperture in the plate with an opening in the support and passing a fastener through both the aperture and the opening.

23. The method of claim 22 wherein the fastener employed is a securement bolt or similar.

* * * * *

UNITED STATES PATENT AND TRADEMARK OFFICE

CERTIFICATE OF CORRECTION

PATENT NO. : 6,726,351 B2
DATED : April 27, 2004
INVENTOR(S) : Dillman

It is certified that error appears in the above-identified patent and that said Letters Patent is hereby corrected as shown below:

Drawings sheets, consisting of Fig. 1 thru Fig. 8, should be deleted and replaced with the drawing sheets, consisting of Fig. 1 thru Fig. 8, as shown on the attached pages.

Signed and Sealed this

First Day of March, 2005

JON W. DUDAS
*Director of the United States Patent and Trademark Office*

(12) United States Patent
Dillman

(10) Patent No.: US 6,726,351 B2
(45) Date of Patent: Apr. 27, 2004

(54) APPARATUS AND METHOD FOR CONTROLLING THE FLOW OF MATERIAL WITHIN ROTARY EQUIPMENT

(75) Inventor: Bruce A. Dillman, Cape Coral, FL (US)

(73) Assignee: Dillman Equipment, Inc., Prairie du Chien, WI (US)

( * ) Notice: Subject to any disclaimer, the term of this patent is extended or adjusted under 35 U.S.C. 154(b) by 98 days.

(21) Appl. No.: 10/167,142

(22) Filed: Jun. 11, 2002

(65) Prior Publication Data

US 2003/0227815 A1 Dec. 11, 2003

(51) Int. Cl.[7] ..... F27B 7/16

(52) U.S. Cl. ..... 366/57; 366/228; 432/118; 34/599; 110/227

(58) Field of Search ..... 366/57, 56, 54, 366/228, 225, 22, 23, 24, 25; 432/118; 110/227; 34/599, 109

(56) References Cited

U.S. PATENT DOCUMENTS

| | | | | |
|---|---|---|---|---|
| 1,009,225 | A | | 11/1911 | Cummer |
| 2,752,130 | A | | 6/1956 | French |
| 2,815,940 | A | | 12/1957 | Madsen |
| 3,098,797 | A | | 7/1963 | Graff et al. |
| 3,296,711 | A | * | 1/1967 | Earl et al. ..... 366/228 |
| 3,409,998 | A | | 11/1968 | Hurst et al. |
| 3,641,683 | A | | 2/1972 | Freeman |
| 3,717,937 | A | | 2/1973 | Thompson |
| 3,780,447 | A | | 12/1973 | Fales |
| 3,814,588 | A | * | 6/1974 | Eweson et al. ..... 34/109 |
| 4,014,643 | A | | 3/1977 | Musha et al. |
| 4,136,966 | A | | 1/1979 | Mendenhall |
| 4,307,520 | A | | 12/1981 | Lutz |
| 4,338,732 | A | | 7/1982 | Coxhill |
| 4,391,206 | A | * | 7/1983 | Matteini ..... 432/118 |
| 4,628,614 | A | | 12/1986 | Thompson |
| 4,940,334 | A | | 7/1990 | Musil |
| 5,083,382 | A | | 1/1992 | Brashears |
| 5,325,610 | A | | 7/1994 | Jou |
| 5,515,620 | A | | 5/1996 | Butler |
| 5,558,432 | A | | 9/1996 | Swisher, Jr. |
| 5,772,317 | A | | 6/1998 | Butler |
| 6,110,430 | A | | 8/2000 | Swisher, Jr. et al. |
| 6,132,560 | A | | 10/2000 | Gerstenkorn |
| 6,185,842 | B1 | | 2/2001 | Brashears |

* cited by examiner

*Primary Examiner*—Tony G. Soohoo
(74) *Attorney, Agent, or Firm*—Wallenstein Wagner & Rockey, Ltd.

(57) ABSTRACT

The present invention is to a method and apparatus for changing the flighting (20) within a mixing drum (12). A plurality of radially spaced apart doors or paddles (30) are connected to one of the two adjacent supports (60). Each door or paddle (30) is pivotally connected (35,34) to the interior (13) of the drum (12) and can be either open or closed depending on which fixed support (60) the door paddle is connected to.

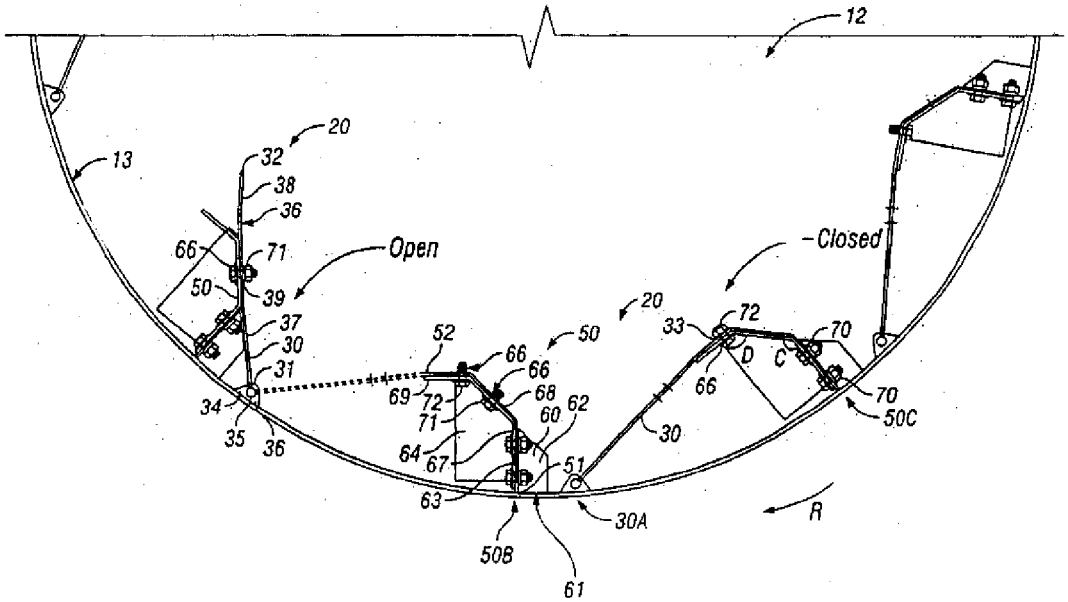

23 Claims, 7 Drawing Sheets